US009181935B2

(12) United States Patent
Knoll

(10) Patent No.: US 9,181,935 B2
(45) Date of Patent: Nov. 10, 2015

(54) PLASMA THRUSTERS

(75) Inventor: Aaron Kombai Knoll, Guildford (GB)

(73) Assignee: ASTRIUM LIMITED, Hertfordshire (GB)

( * ) Notice: Subject to any disclaimer, the term of this patent is extended or adjusted under 35 U.S.C. 154(b) by 1059 days.

(21) Appl. No.: 13/203,774

(22) PCT Filed: May 27, 2011

(86) PCT No.: PCT/GB2011/051016

§ 371 (c)(1), (2), (4) Date: Aug. 29, 2011

(87) PCT Pub. No.: WO2011/151636

PCT Pub. Date: Dec. 8, 2011

(65) Prior Publication Data

US 2012/0167548 A1 Jul. 5, 2012

(30) Foreign Application Priority Data

Jun. 1, 2010 (GB) ..... 1009078.5

(51) Int. Cl.
*F03H 1/00* (2006.01)

(52) U.S. Cl.
CPC ..... *F03H 1/0056* (2013.01); *F03H 1/00* (2013.01); *F03H 1/0037* (2013.01); *F03H 1/0062* (2013.01); *F03H 1/0068* (2013.01); *F03H 1/0075* (2013.01)

(58) Field of Classification Search
CPC ..... F03H 1/0056; F03H 1/00; F03H 1/0037; F03H 1/0043; F03H 1/005; F03H 1/0062; F03H 1/0068; F03H 1/0075; H01J 3/32; H01J 29/46; H01J 29/465; H01J 27/00; H01J 27/14; H01J 27/143; H01J 27/146; H05H 1/0087; H05H 1/50; H05H 1/24
See application file for complete search history.

(56) References Cited

U.S. PATENT DOCUMENTS

| | | | | |
|---|---|---|---|---|
| 4,277,939 | A | 7/1981 | Hyman, Jr. | |
| 4,466,242 | A | 8/1984 | Sovey et al. | |
| 5,845,880 | A * | 12/1998 | Petrosov et al. | 244/169 |
| 2003/0048053 | A1 | 3/2003 | Kornfeld et al. | |

(Continued)

FOREIGN PATENT DOCUMENTS

| | | |
|---|---|---|
| EP | 0 778 415 A1 | 6/1997 |
| GB | 711929 A | 7/1954 |

(Continued)

OTHER PUBLICATIONS

Search Report dated Sep. 16, 2010, issued in the corresponding United Kingdom Patent Application No. 1009078.5.

(Continued)

*Primary Examiner* — Phutthiwat Wongwian
*Assistant Examiner* — William Breazeal
(74) *Attorney, Agent, or Firm* — Buchanan Ingersoll & Rooney PC

(57) ABSTRACT

A plasma thruster includes a plasma chamber having first and second axial ends, the first of which is open, an anode located at the second axial end, and a cathode. The cathode and anode are arranged to produce an electric field having at least a component in the axial direction of the thruster. A magnet system including a plurality of magnets is spaced around the thruster axis, each magnet having its north and south poles spaced around the axis.

20 Claims, 4 Drawing Sheets

(56) References Cited

U.S. PATENT DOCUMENTS

| | | | | |
|---|---|---|---|---|
| 2005/0212442 | A1 | 9/2005 | Kornfeld et al. | |
| 2008/0093506 | A1 * | 4/2008 | Emsellem et al. | 244/169 |
| 2010/0146931 | A1 | 6/2010 | King et al. | |

FOREIGN PATENT DOCUMENTS

| | | | |
|---|---|---|---|
| JP | 62-195472 | | 8/1987 |
| JP | 62-195472 | U | 12/1987 |
| RU | 2079984 | C1 | 5/1997 |
| RU | 2 216 134 | | 11/2003 |

OTHER PUBLICATIONS

Search Report issued on Jul. 27, 2011, by British Patent Office for Application No. 1009078.5.

Notification Concerning Transmittal of International Preliminary Report on Patentability (Forms PCT/IB/326 and PCT/IB/373) and the Written Opinion of the International Searching Authority (Form PCT/ISA/237) dated Dec. 13, 2012, issued in corresponding International Application No. PCT/GB2011/051016. (8 pages).

* cited by examiner

PLASMA THRUSTERS

FIELD OF THE INVENTION

The present invention relates to plasma thrusters which can be used, for example, in the control of space probes and satellites.

BACKGROUND TO THE INVENTION

Plasma thrusters are known which comprise a plasma chamber with an anode and a cathode which set up an electic field in the chamber, the cathode acting as a source of electrons. Magnets provide regions of high magnetic field in the chamber. A propellant, typicaly a noble gas, is introduced into the chamber. Electrons from the cathode are accelerated through the chamber, ionizing the propellant to form a plasma. Positive ions in the plasma are accelerated towards the cathode, which is at an open end of the chamber, while electons are deflected and captured by the magnetic field, because of their higher charge/mass ratio. As more propellant is fed into the chamber the primary electrons from the cathode and the secondary electrons from the ionization process continue to ionize the propellant, projecting a continuous stream of ions from the open end of the thruster to produce thrust.

Examples of multi-stage plasma thrusters are described in US2003/0048053, and divergent cusped field (DCF) thrusters are also known.

SUMMARY OF THE INVENTION

The present invention provides a plasma thruster comprising a plasma chamber having first and second ends. The first end may be open. There may be an anode located at the second end. There may be a cathode. The cathode and/or the anode may be arranged to produce an electric field having at least a component in the axial direction of the thruster. The system further comprises a magnet system comprising a plurality of magnets. The magnets may be spaced around the thruster axis. Each magnet may have its north and south poles spaced from each other around the axis. The plurality magnets may comprise an even number of magnets with alternating polarity so that each pole of each magnet is adjacent to a like pole of the adjacent magnet. Each of the magnets may be orientated so that its poles are spaced apart in a direction perpendicular to the axial direction.

The plasma thruster may further comprise a supply of propellant, which may be arranged to supply propellant into the chamber, for example at the second end of the chamber.

At least one of the magnets may be an electromagnet arranged to produce a variable magnetic field.

Indeed the present invention further provides a plasma thruster comprising a plasma chamber having first and second axial ends, the first of which may be open, an anode, which may be located at the second axial end, and a cathode, wherein the cathode and anode are arranged to produce an electric field which may have at least a component in the axial direction of the thruster, and a magnet system comprising a plurality of magnets located around the chamber so as to generate magnetic fields in the chamber, and wherein at least one of the magnets is an electromagnet arranged to produce a magnetic field which is variable. This may be arranged to vary the net direction or the net position of thrust of the thruster.

Each of the magnets may be an electromagnet arranged to produce a variable magnetic field.

The present invention further provides a plasma thruster system comprising a thruster according to the invention and a controller arranged to receive a demand for thrust, and to control the at least one electromagnet so that the thruster generates the demanded thrust.

The controller may be arranged to generate a non-axial thrust by controlling the magnetic field generated by each of two adjacent magnets so that it is less than the magnetic field generated by each of at least two other magnets.

Preferred embodiments of the present invention will now be described by way of example only with reference to the accompanying drawings.

DESCRIPTION OF THE PREFERRED EMBODIMENTS

Figure 1:
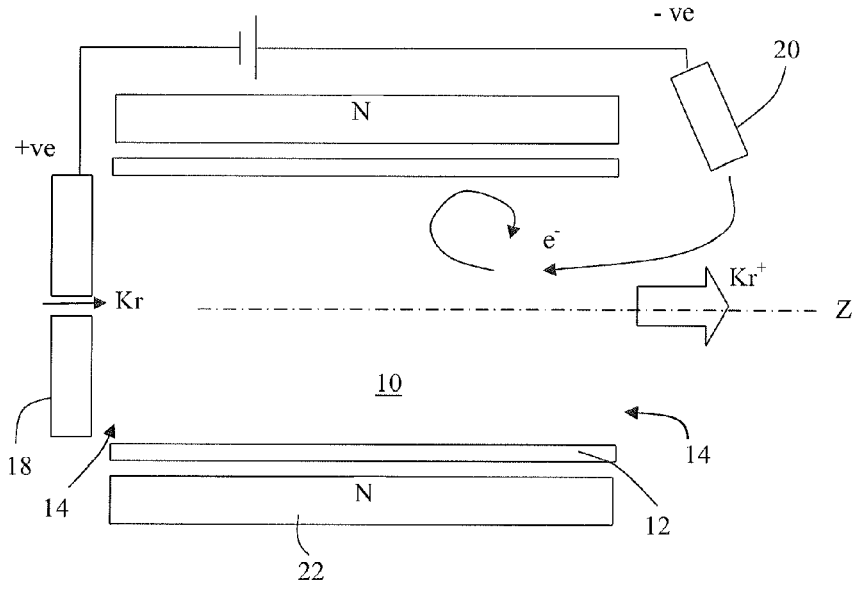
FIG. 1 is a longitudinal section through a thruster according to an embodiment of the invention.
Figure 2:
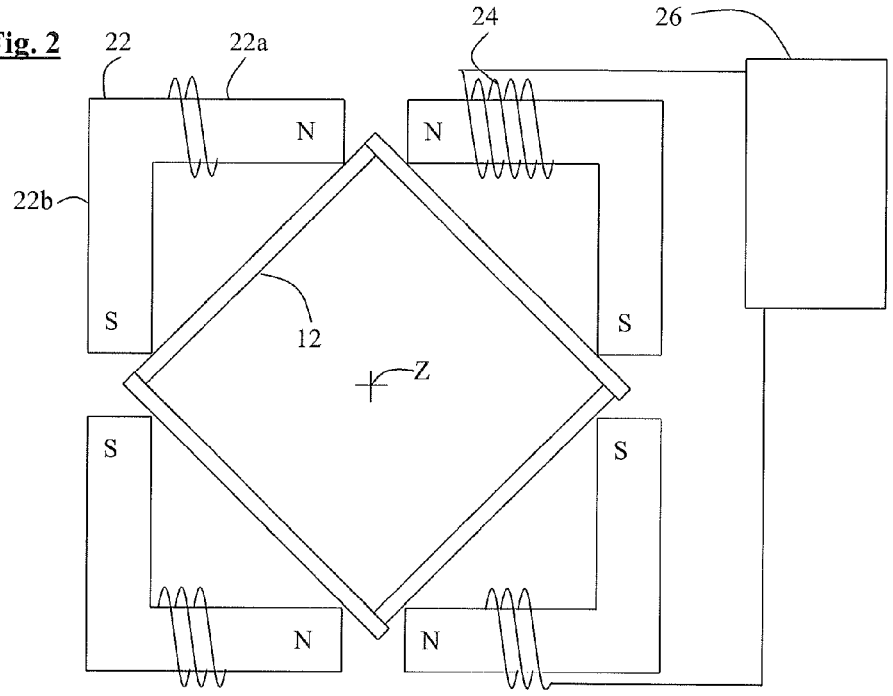
FIG. 2 is a transverse section through the thruster of FIG. 1.

Referring to FIGS. 1 and 2, a plasma thruster comprises a plasma chamber 10 having four ceramic side walls 12 arranged symmetrically around the central axis Z of the thruster. One end 14 of the plasma chamber is open. At the other end 16 an anode 18 covers the end of the plasma chamber so that that end is closed. A cathode 20 is located at the open end 14 of the chamber 10 offset from the axis Z. The anode 18 and cathode 20 are therefore arranged to generate an electric field which extends generally in the axial direction of the thruster. A propellant inlet 21 is arranged to allow propellant to enter the chamber 10. The propellant inlet 21 is located at the closed end of the chamber 10, approximately on the Z axis. The inlet is connected to a supply of propellant which in this case is krypton, though other propellants such as argon and xenon can be used.

Four electromagnets 22 are spaced around the plasma chamber 10, each having its poles spaced apart from each other around the axis Z so that they are located at adjacent corners of the chamber 10. The magnets are arranged perpendicular to the Z axis. They are aligned with each other in the Z direction, i.e. in a common X-Y plane. The polarities of the magnets 22 alternate, so that each has its north pole adjacent to the north pole of one of the adjacent magnets and its south pole adjacent the south pole of the other adjacent magnet. While straight magnets, parallel to the walls 12 of the chamber 10 could be used, in this embodiment the core of each magnet 22 has two straight arms 22*a*, 22*b* joined together to form a right angle, and the magnet 22 is arranged such that each of the arms is at 45° to the chamber wall 12. Each arm 22*a*, 22*b* of each magnet is in the form of a plate which extends along substantially the whole of the length of the chamber 10 in the axial Z direction. Each of the electromagnets has a coil 24 wound around the arms 22*a*, 22*b* of its core, and the coil is connected to a power supply which is controlled by a controller 26 so that the current through the coils 24 can be varied. The controller 26 is arranged to control the current in each of the coils 24 so as to control the strength of the magnetic field generated by each of the electromagnets 22. The controller 26 is also arranged to control the other parameters of the thruster, such as the voltage of the cathode and anode and the supply of propellant. When the thruster is used to control the orientation of a probe or satellite, the controller 26 is arranged to receive a demand for thrust from a main controller and to control the current in each of the coils 24 so as to produce the demanded thrust.

Figure 3:
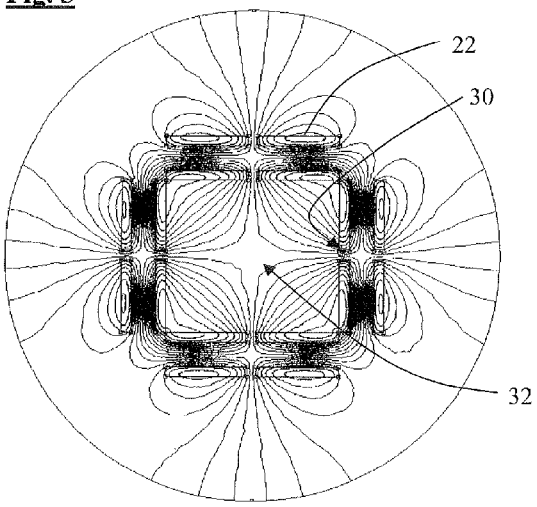
FIG. 3 is a diagram of the magnetic field in the thruster of FIG. 1.

Referring to FIG. 3, in which the magnets 22 are shown but not the chamber walls 12, if all of the electromagnets are generating an equal magnetic field, that field has four cusps 30, each of which is located at a pair of adjacent and opposite poles of two of the adjacent electromagnets 22, and a further central cusp 32 at the centre of the chamber 10 on the Z axis. Simulations show that this magnetic field pattern is reasonably constant along the length of the chamber 10, and diverges gradually at the ends of the of the chamber.

In operation, the anode 18 and cathode 20 set up an electric field approximately axially along the length of the chamber 10 in the Z direction, and electrons from the cathode 20 are therefore accelerated through the chamber 10 towards the anode 18. As krypton propellant is introduced into the chamber 10, the accelerated electrons ionize the krypton producing positive ions and further secondary electrons. The electrons, because of their relatively high charge to mass ratio, are deflected by the magnetic field in the chamber and tend to follow the magnetic field, while the positive ions are relatively unaffected by the magnetic field and are therefore ejected from the open end of the chamber 10 producing thrust. The chamber 10 therefore forms a thruster channel along which the ions are accelerated. It will be appreciated that varying the magnetic field within the chamber or channel 10 can be used to vary the electron density at different points across the channel 10. It is anticipated that varying the magnetic field strength in different areas around the Z axis of the thruster can be used to provide thrust vectoring.

Figure 4A:
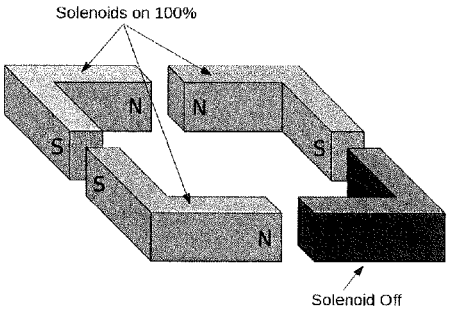
FIGS. 4*a* and 4*b* show the effect on the magnetic field of reducing the current in one of the electromagnets of the thruster of FIG. 1.
Figure 4B:
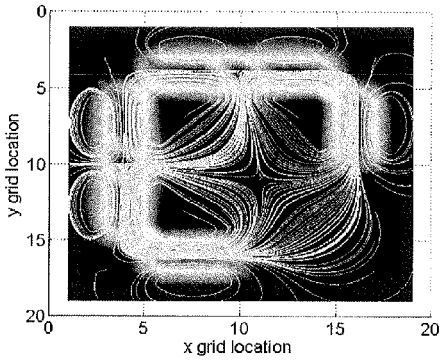
Figure 5A:
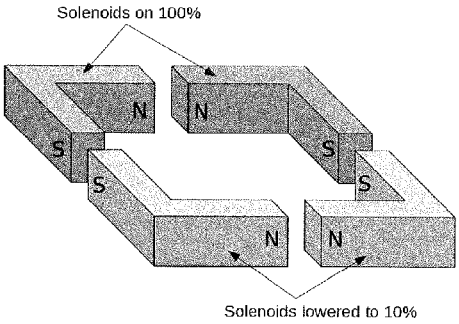
FIGS. 5*a* and 5*b* show the effect on the magnetic field of reducing the current in two of the electromagnets of the thruster of FIG. 1.
Figure 5B:
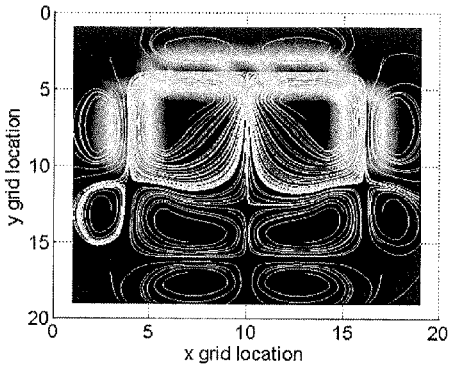

Referring to FIGS. 4*a* and 4*b*, simulations show that, if one of the four electromagnets 22 is turned off, the central cusp 32 of the magnetic field does not shift significantly from the centre of the channel 10. However, referring to FIGS. 5*a* and 5*b*, if two adjacent electromagnets are turned off, or redcued to 10% of the current of the other two, then the central cusp 32 of the magnetic field shifts significantly, towards one corner of the channel 10.

Figure 6A:
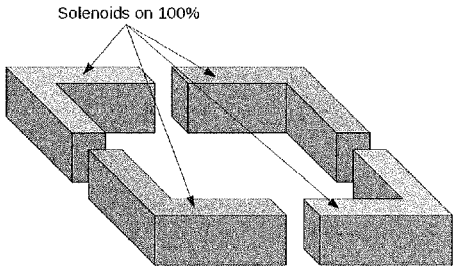
FIGS. 6*a* and 6*b* show the distribution of electron density in the thruster of FIG. 1 with equal current in all four electromagnets.
Figure 6B:
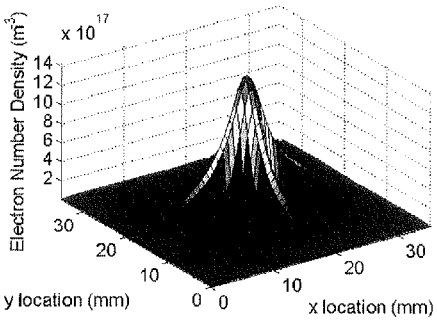

Referring to FIGS. 6*a* and 6*b*, simulations show that, with all four electromagnets receiving equal currents, and the magnetic field therefore being symmentrical, the electron density shows a sharp peak at the cusp 32 in the magnetic field at the centre of the channel 10. This peak radiates out in a cross configuration following the magnetic field lines towards the magnetic poles. The occurrence of this strong confinement of the electrons by the magnetic field, which is a result of the configuration of the magnets 22, leads to a high ionization efficiency in the thruster and hence a high thrust efficiency. If electron temperature is simulated, the temperature follows the same pattern as the electron density, being highest at the central cusp 32.

Figure 7A:
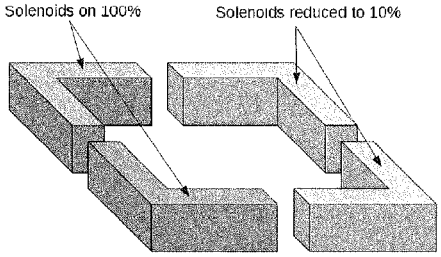
FIGS. 7*a*, 7*b* and 7*c* show the distribution of electron density, and the variation in thrust centre offset with axial distance from the channel exit, in the thruster of FIG. 1 with reduced current in two of the electromagnets.
Figure 7B:
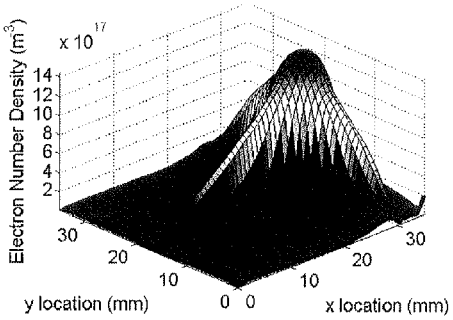

Referring to FIGS. 7*a* and 7*b*, if two adjacent magnets 22 are reduced to 10% of the strength of the other two, then the electron density peak shifts with the cusp 32 in the magnetic field, so that the peak is offset to one side of the Z axis of the thruster. Again, the electron temperature distribution shifts in the same way.

From the results of the simulation discussed above and shown in FIGS. 6*b* and 7*b* we can see that the plasma properties vary considerably across the channel for the case of a 'steered' magnetic field. This non-uniform distribution in electron density and temperature is expected to give rise to a non-uniform distribution of plasma potential, leading to an inclined electric field that will enhance thrust vectoring. However, in the worst case scenario the electric field will remain exactly parallel to the thruster Z axis, and the intensity of the ion beam will be relocated in a 2-dimensional x-y plane.

Figure 7C:
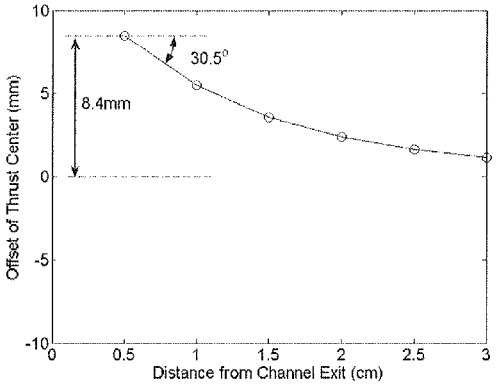

Assuming the electric field is uniform across the channel, there will be a small amount of thrust vectoring from the action of ambipolar diffusion of the ion beam. As the ions are accelerated from the thruster chamber they will diverge at a theoretically predictable rate. In the case of a non-uniform beam, such as that of FIG. 7*b*, this will result in a shift of the center of thrust varying with the axial distance from the chamber exit. If the center of thrust as a function of axial location from the channel exit is analysed, the results are as shown in FIG. 7*c*. It can be seen from these results that in the worst case scenario there should be a beam vectoring capability of 30.5°, with a 8.4 mm offset of the center of thrust compared to the axis of the thruster, in a chamber with a 35 mm square cross section. It will therefore be appreciated that both the net position of the thrust and the net direction of the thrust can be varied under the control of the controller 24.

Figure 8A:
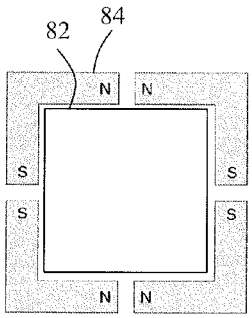
FIGS. 8*a* and 8*b* illustrate alternative magnet arrangements to that of the thruster of FIG. 1.

Referring to FIG. 8*a*, in a further embodiment of the invention the chamber walls 82 are aligned with the arms of the magnets 84 so that the magnetic poles are located in the centre of each side of the ceramic chamber rather than in the corners of the ceramic chamber.

Figure 8B:
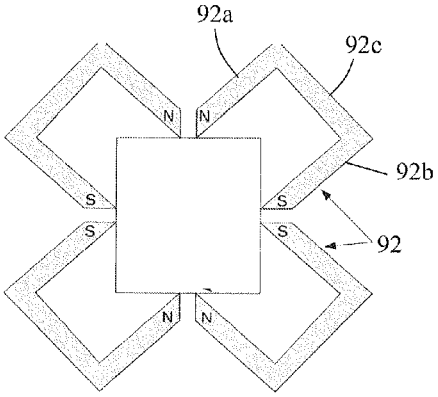
Figure 9:
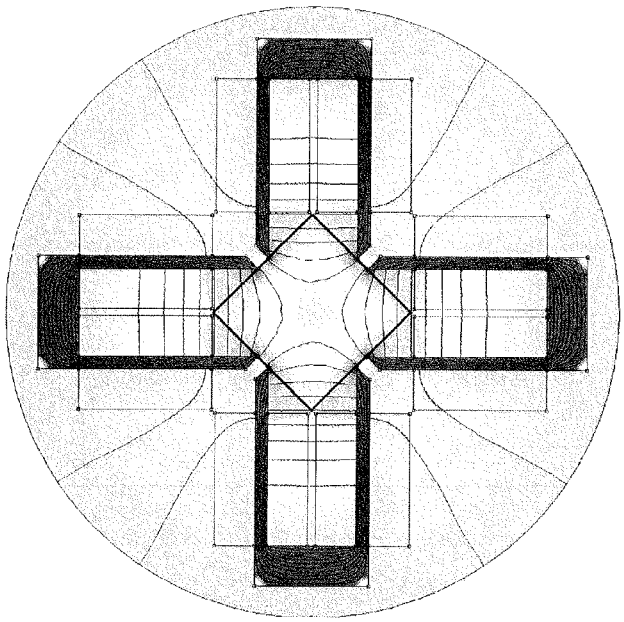
FIG. 9 shows the magnetic field in a thruster having a similar topology to that of FIG. 8*b*.

Referring to FIG. 8*b*, in a further embodiment of the invention each of the electromagnets 92 is in the form of a horseshoe magnet having two parallel arms 92*a*, 92*b* joined by a backpiece 92*c*. This arrangement allows for more coil windings per magnet and therefore allows higher field strength to be generated for a given maximum electrical current. However the design is obiously bulkier and heavier than the design of FIG. 2 or that of FIG. 8*a*. The magnetic field in the design of FIG. 8*a* is shown in FIG. 8*b*. As would be expected, as shown in FIG. 9, the magnetic field within the chamber for the magnet topology of FIG. 8*b* is similar to the design of FIG. 2, because the magnetic poles are located in the same place relative to the chamber 10.

While each of the embodiments described above has four magnets, it will be appreciated that other numbers of magnets can be used. For example six or eight magnets arranged in a similar configuration, with alternating polarities around the Z axis, would produce similar peaks in electron density, and would be steerable in a similar manner. It will also be appreciated that the use of electromagnets to steer the thrust can be carried over to other thruster topologies in which the magnets are aligned differently.

The invention claimed is:

1. A plasma thruster comprising:

a plasma chamber having first and second axial ends along an axial direction of the plasma thruster, the first axial end being open;

an anode located at the second axial end;

a cathode located at the first axial end, wherein the cathode and the anode are arranged to produce an electric field having at least a component in the axial direction of the plasma thruster, the axial direction of the plasma thruster defining a thruster axis; and a magnet system having a plurality of magnets spaced around the thruster axis, the plurality of magnets being between the anode and cathode, and each magnet of the plurality of magnets having its north and south poles spaced circumferentially about the thruster axis.

2. The plasma thruster according to claim 1, wherein the plurality of magnets comprises:

an even number of magnets with alternating polarity so that each pole of each magnet is adjacent to a like pole of an adjacent magnet.

3. The plasma thruster according to claim 1, wherein each of the plurality of magnets is orientated so that its poles are spaced apart in a direction perpendicular to the axial direction.

4. The plasma thruster according to claim 1, comprising:

a supply of propellant arranged to supply propellant into the second axial end of the plasma chamber.

5. The plasma thruster according to claim 1, wherein at least one of the plurality of magnets is an electromagnet arranged to produce a variable magnetic field.

6. The plasma thruster according to claim 1, wherein each of the plurality of magnets is an electromagnet arranged to produce a respective variable magnetic field.

7. A plasma thruster system comprising: the plasma thruster according to claim 5; and a controller arranged to receive a demand for thrust which defines a thrust direction, and to control the at least one electromagnet so that the plasma thruster generates thrust in the demanded thrust direction.

8. The plasma thruster system according to claim 7, wherein the controller is arranged to generate a non-axial thrust by controlling a first magnetic field generated by two adjacent magnets so that it is less than a second magnetic field generated by at least two other magnets.

9. The plasma thruster according to claim 1, wherein the thruster axis is a central axis of the plasma thruster around which the plasma chamber and the magnet system are symmetrically arranged.

10. The plasma thruster according to claim 1, wherein the electric field produced by the cathode and anode extends along the thruster axis.

11. The plasma thruster according to claim 1, wherein each of the plurality of magnets includes a respective core having a respective first arm extending in a respective first direction and a respective second arm extending in a respective second direction, each respective first direction being perpendicular to each respective second direction, and respective first and second directions each being perpendicular to the thruster axis.

12. The plasma thruster according to claim 11, wherein the respective first and second arms of each of the plurality of magnets respectively extends in the axial direction of the thruster.

13. The plasma thruster according to claim 11, wherein, for each of the plurality of magnets, a respective north pole of is arranged at an end of the respective first arm of each of the plurality of magnets, and a respective south pole is arranged at an end of the respective second arm of each of the plurality of magnets.

14. The plasma thruster according to claim 11, wherein the plasma chamber includes a plurality of chamber walls arranged symmetrically around the axial direction of the thruster, and wherein the respective first and second arms of each of the plurality of magnets are arranged at 45° with respect to a corresponding one of the plurality of chamber walls.

15. The plasma thruster according to claim 11, wherein the plasma chamber includes a plurality of chamber walls arranged symmetrically around the axial direction of the thruster, and wherein the respective first and second arms of each of the plurality of magnets are respectively arranged parallel to a corresponding one of the plurality of chamber walls.

16. The plasma thruster according to claim 15, wherein the respective north and south poles of each of the plurality of magnets are respectively arranged proximate to a respective central part of the corresponding one of the plurality of chamber walls.

17. The plasma thruster according to claim 1, wherein each of the plurality of magnets includes a respective core having respective first and second arms extending in a respective first direction, and a respective backpiece extending in a respective second direction, each respective first and second arms being joined to the respective backpiece, each respective first direction being perpendicular to each respective second direction, and each first and second directions being perpendicular to the thruster axis.

18. The plasma thruster according to claim 17, wherein the plasma chamber includes a plurality of chamber walls arranged symmetrically around the axial direction of the thruster, and wherein the respective first and second arms of each of the plurality of magnets are arranged at 45° with respect to a corresponding one of the plurality of chamber walls.

19. The plasma thruster according to claim 18, wherein, for each of the plurality of magnets, a respective north pole is arranged at an end of one of the respective first and second arms, and a respective south pole is arranged at an end of the other one of the respective first and second arms.

20. The plasma thruster according to claim 18, wherein the respective north and south poles of each of the plurality of magnets are respectively arranged proximate to a central part of the corresponding one of the plurality of chamber walls.

* * * * *